US007384195B2

(12) United States Patent
Johansen

(10) Patent No.: US 7,384,195 B2
(45) Date of Patent: Jun. 10, 2008

(54) BAG WITH ZIPPERED POUCH

(75) Inventor: Erik Johansen, Oroville, CA (US)

(73) Assignee: Roplast Industries, Inc., Oroville, CA (US)

( * ) Notice: Subject to any disclaimer, the term of this patent is extended or adjusted under 35 U.S.C. 154(b) by 517 days.

(21) Appl. No.: 10/886,665

(22) Filed: Jul. 9, 2004

(65) Prior Publication Data

US 2006/0008183 A1 Jan. 12, 2006

(51) Int. Cl.
*B65D 30/22* (2006.01)
*B65D 33/16* (2006.01)

(52) U.S. Cl. ..... 383/40; 383/61.2

(58) Field of Classification Search ..... 383/6, 383/120, 38, 40, 123–124, 63, 207, 209, 383/61.2, 37, 2; 229/87.18, 87.19
See application file for complete search history.

(56) References Cited

U.S. PATENT DOCUMENTS 4,498,192 A * 2/1985 Becker et al. ..... 383/126
4,787,517 A * 11/1988 Martin ..... 383/203
5,048,692 A * 9/1991 Handler et al. ..... 383/203
5,121,997 A * 6/1992 La Pierre et al. ..... 383/203
5,174,659 A * 12/1992 Laske ..... 383/207
5,660,479 A * 8/1997 May et al. ..... 383/204
5,893,645 A * 4/1999 May ..... 383/208
6,149,302 A * 11/2000 Taheri ..... 383/5
6,254,907 B1 * 7/2001 Galomb ..... 426/115
6,264,366 B1 * 7/2001 Custer ..... 383/5
6,910,805 B2 * 6/2005 Johnson ..... 383/61.2
7,094,455 B2 * 8/2006 Johnson et al. ..... 428/40.1
7,204,368 B2 * 4/2007 Cheaure et al. ..... 206/440

* cited by examiner

*Primary Examiner*—Jes F Pascua
(74) *Attorney, Agent, or Firm*—Gordon & Rees, LLP

(57) ABSTRACT

A bag having a tear-away zipper-closable pouch, made from: a first sheet of plastic; a second sheet of plastic bonded to the first sheet of plastic; a zipper attached to both the first and second sheets of plastic; and a tear-away perforation through the first and second sheets of plastic adjacent to the zipper.

9 Claims, 6 Drawing Sheets

BAG WITH ZIPPERED POUCH

TECHNICAL FIELD

The present invention relates to disposable plastic bags such as those used for delivering newspapers.

BACKGROUND OF THE INVENTION

Newspapers are typically distributed rolled up in clear plastic bags. Such plastic bags are especially useful when delivering large weekend editions of newspapers, or when delivering newspapers in rainy conditions.

Many newspaper delivery bags have a bottom portion in which advertisers enclose a product sample (e.g.: soap, shampoo). This bottom portion is ripped open and the product sample is removed.

SUMMARY OF THE INVENTION

In a first embodiment, the present invention provides a bag having a tear-away zipper-closable pouch, including: a first sheet of plastic; a second sheet of plastic bonded to the first sheet of plastic; a zipper attached to both the first and second sheets of plastic; and a tear-away perforation through the first and second sheets of plastic adjacent to the zipper.

In a second embodiment, the present invention provides a bag having a tear-away zipper-closable pouch, including: a sheet of plastic; a zipper having opposite sides, each of the opposite sides being attached to the sheet of plastic; and a tear-away perforation through the sheet of plastic adjacent to the zipper.

DETAILED DESCRIPTION OF THE DRAWINGS

The present invention provides a plastic bag having a removable zippered pouch. In a first embodiment (FIGS. 2A to 3) the plastic bag and zippered pouch are made from two sheets of plastic bonded together. In a second embodiment (FIG. 4) the plastic bag and zippered pouch is made from a single sheet of plastic bonded over upon itself.

Figure 1:
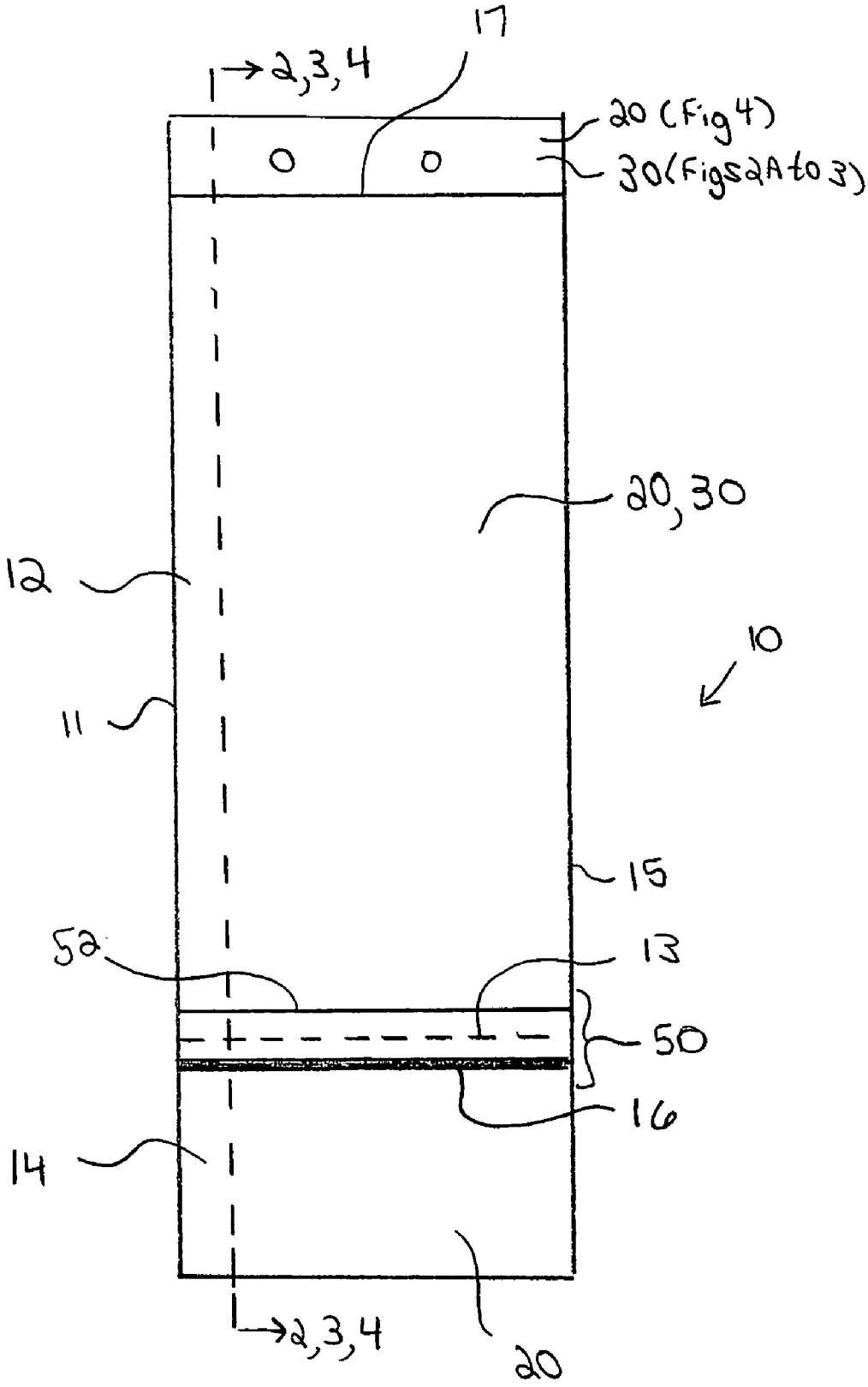
FIG. 1 is a front view of a plastic bag having a zippered pouch.

FIG. 1 is a front view of a bag and zippered pouch system 10 including a bag 12 and a pouch 14. A tear away line 13 is formed by perforations through bag 12. A zipper 16 is found below perforated tear away line 13.

Figure 2A:
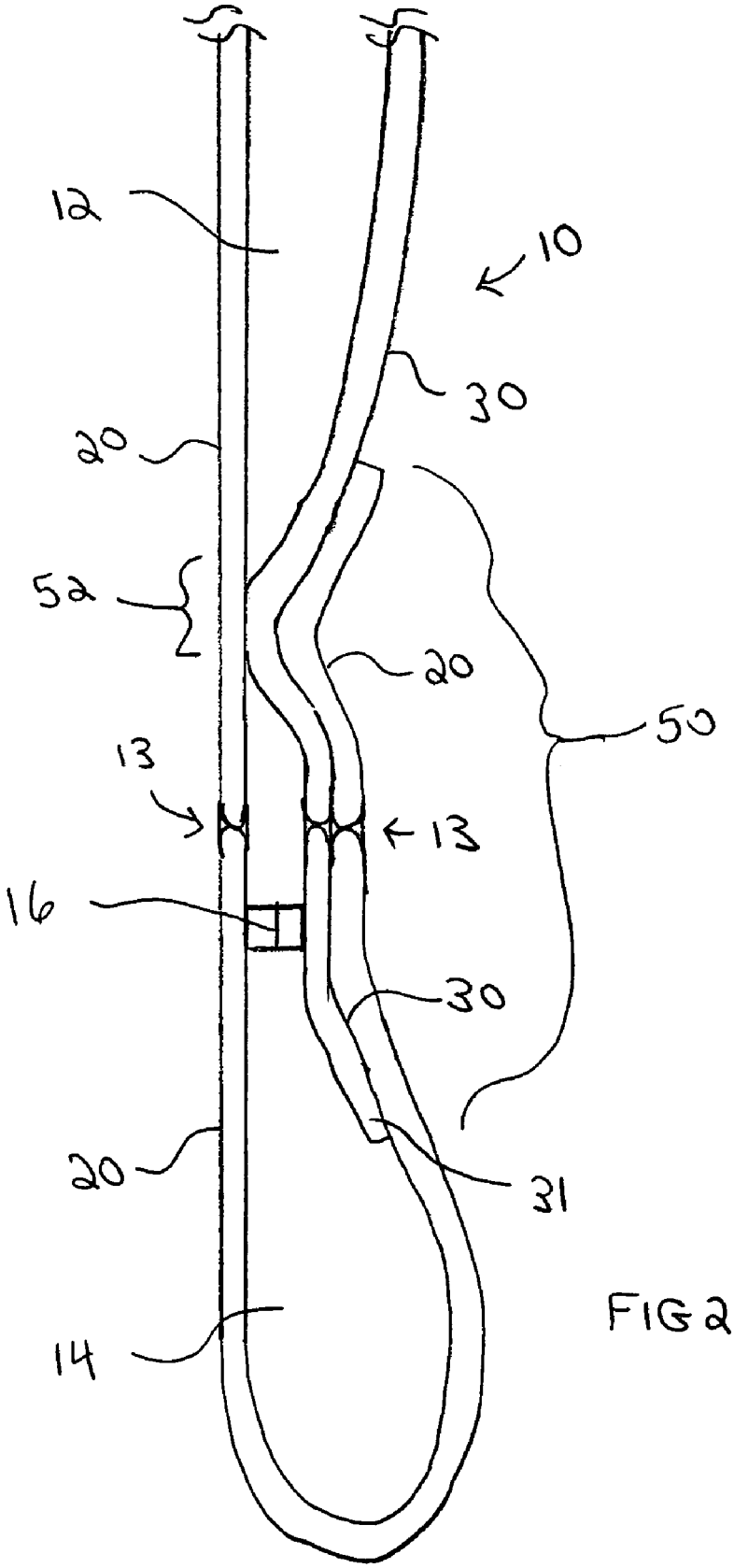
FIG. 2A is a sectional side view of a first embodiment of the invention taken along line 2-2 in FIG. 1.

FIG. 2A is a sectional side view of a first embodiment of system 10. (The thickness of the plastic sheets forming bag 12 and pouch 14 in FIGS. 2A to 4 has been exaggerated throughout FIGS. 2A to 4 for clarity of illustration). In the embodiment shown in FIG. 2A, bag 12 and pouch 14 are formed by a first sheet of plastic 20 and a second sheet of plastic 30. Specifically, first plastic sheet 20 is folded around an end 31 of second plastic sheet 30.

First sheet of plastic 30 and second sheet of plastic 40 are bonded together (for example by heating) in regions 50 and 52. As seen in FIG. 1, regions 50 and 52 span across system 10 from side 11 to side 15. In addition, sheets 20 and 30 are bonded together along sides 11 and 15 of system 10. The top end 17 of sheet 20 is not bonded to sheet 30 as shown in FIGS. 2A to 30, (or sheet 20 as shown in FIG. 4) thus leaving a top opening in bag 12. A newspaper can then be rolled up and inserted into bag 12 through top opening 17.

Returning to FIG. 2A, a zipper 16 is also provided. Zipper 16 is preferably thermally bonded into system 10. In the illustrated embodiment, one side of zipper 16 is bonded to first plastic sheet 20 and the other side of zipper 16 is bonded to second plastic sheet 30.

Figure 2B:
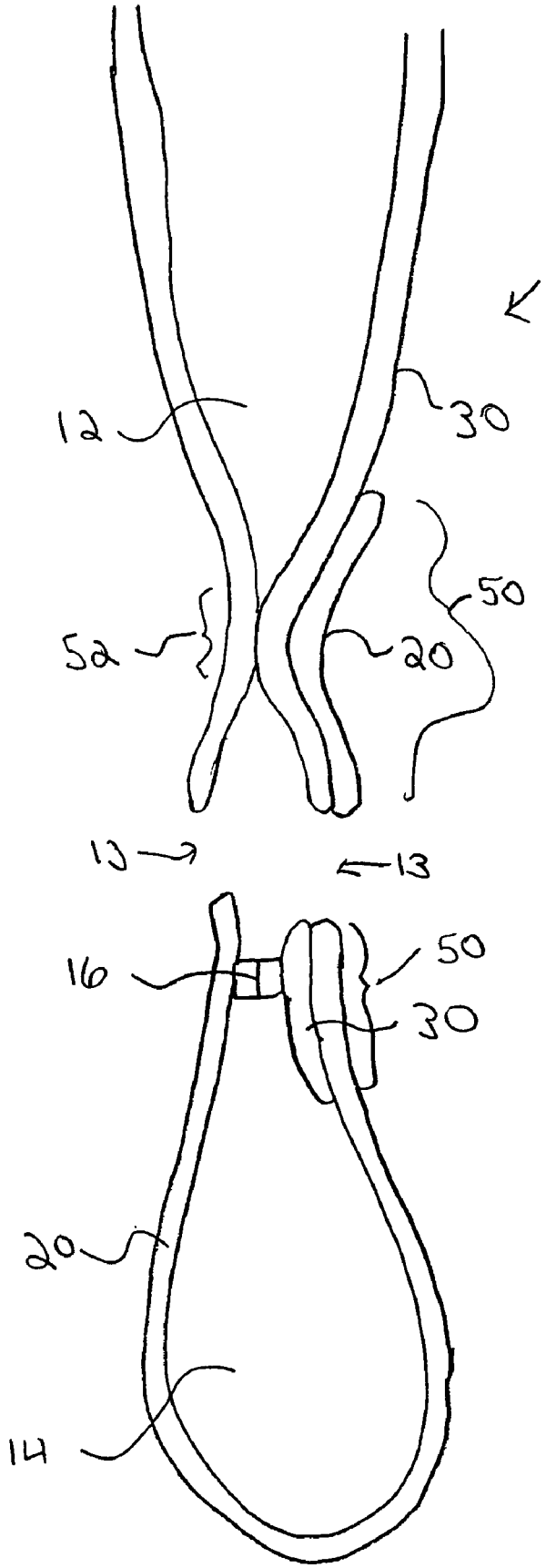
FIG. 2B is a view corresponding to FIG. 2A, with the zippered pouch removed from the bag.
Figure 2C:
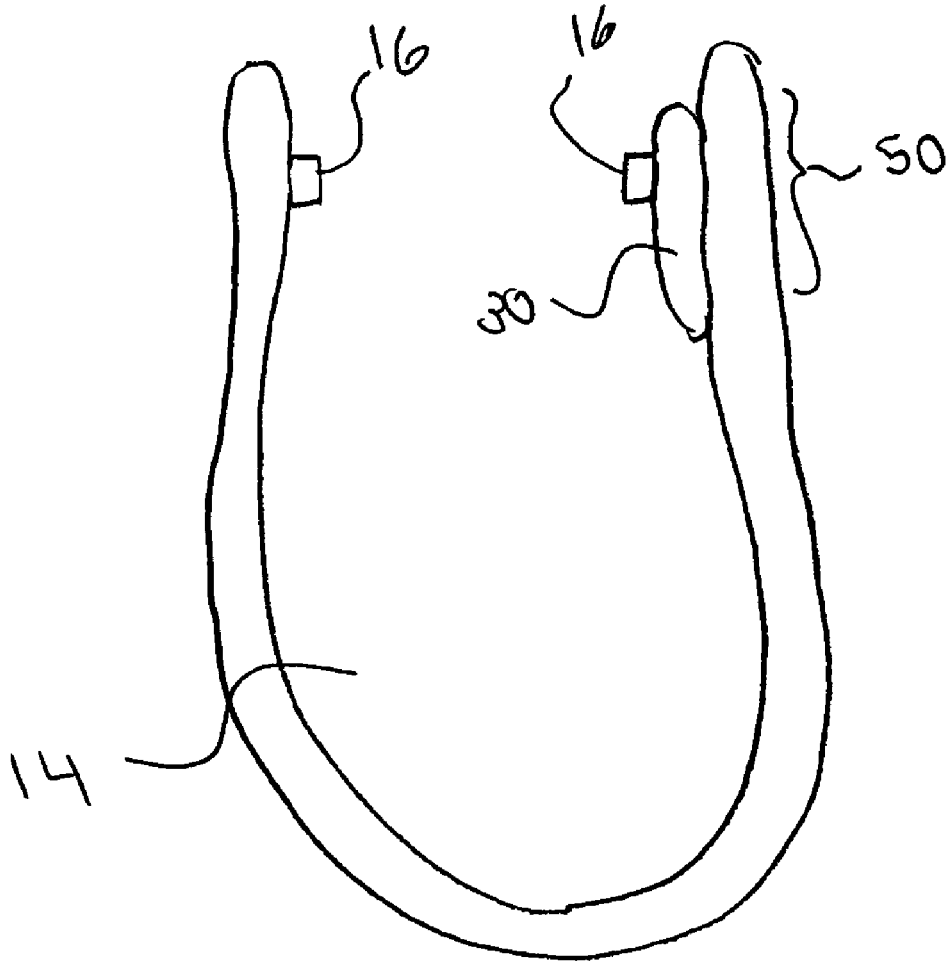
FIG. 2C is a view corresponding to FIG. 2B, showing an opened zippered pouch.

FIG. 2B shows zippered pouch 14 being removed from the bag 12 by tearing through perforated tear away line 13. FIG. 2C shows the zippered pouch 14 opened (by opening zipper 16). Pouch 14 can thus be used for storing items in (when zipper 16 has been resealed). In one contemplated use of the present invention, bag 12 is marked with advertising urging a customer to collect box tops, store the box tops in pouch 14, and then return the box tops to the advertiser as part of a product promotion.

Figure 3:
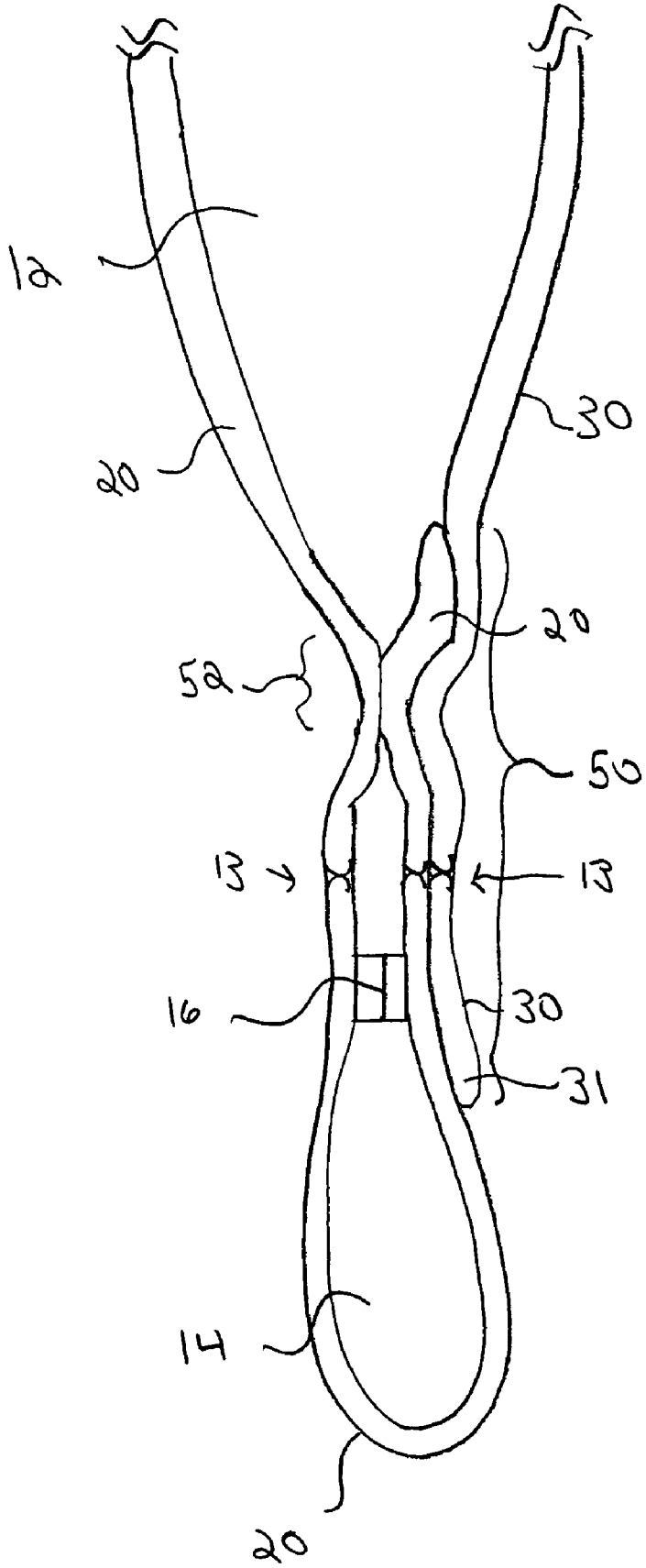
FIG. 3 is a sectional side view of a second embodiment of the invention taken along line 3-3 in FIG. 1.
Figure 4:
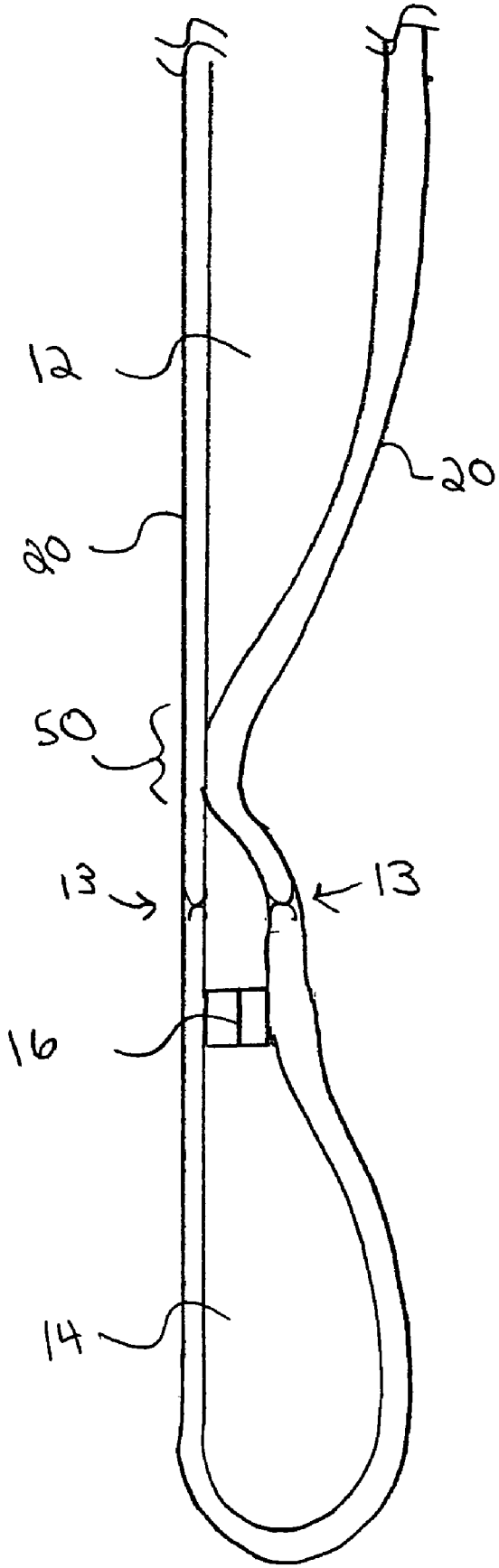
FIG. 4 is a sectional side view of a third embodiment of the invention taken along line 4-4 in FIG. 1.

FIG. 3 is a sectional side view of a second embodiment of the invention, as follows. Similar to the embodiment in FIG. 2A, bag 12 and pouch 14 of FIG. 3 are also formed by a first sheet of plastic 20 and a second sheet of plastic 30. However, first plastic sheet 20 is instead folded under end 31 of second plastic sheet 30. First sheet of plastic 30 and second sheet of plastic 40 are bonded together (for example by heating) in regions 50 and 52. Opposite sides of zipper 16 are thus both bonded to first plastic sheet 20.

In the embodiments of the invention shown in FIGS. 2A to 3, one side of zipper 16 is bonded to first sheet of plastic 20 and the other side of zipper 16 is bonded to both first and second sheets of plastic 20 and 30.

FIG. 4 is a sectional side view of a third embodiment of the invention, as follows. Bag 12 and pouch 14 are formed by a first sheet of plastic 20 wrapped over upon itself and bonded to itself in region 50. Opposite sides of zipper 16 are bonded to first sheet of plastic 20 as shown.

In any of the embodiments of the present invention, plastic sheets 20 and 40 may be made of Low Density Polyethylene (which may optionally be blended with other Polyethylene resins). It is to be understood, however, that the present invention is not limited to any particular materials.

What is claimed is:

1. A bag having a closed bottom end with a tear-away zipper-closable pouch connected to the closed bottom end, comprising: a first sheet of plastic; a second sheet of plastic having an inner surface and an outer surface, the outer surface bonded to the first sheet of plastic to form the closed bottom end of the bag; a zipper attached to both the first and second sheets of plastic; and a tear-away perforation through the first and second sheets of plastic adjacent to the zipper, wherein the first and second sheets of plastic together form the bag and the pouch, and wherein the pouch is sealable by the zipper after the pouch has been removed from the closed bottom end of the bag, wherein the first sheet of plastic is folded around an end of the second sheet of plastic, and wherein the first sheet of plastic is bonded to the second sheet of plastic at two locations.

2. The bag of claim 1, wherein the tear-away perforation through the first and second sheets of plastic is disposed between the two locations where the first sheet of plastic is bonded to the second sheet of plastic.

3. The bag of claim 1, wherein one side of the zipper is attached to the first sheet of plastic and the other side of the zipper is attached to the second sheet of plastic.

4. The bag of claim 1, wherein one of the two locations where the first sheet of plastic is bonded to the second sheet of plastic is along one side of the zipper.

5. The bag of claim 1, wherein the first sheet of plastic is folded around an end of the second sheet of plastic, and wherein the first sheet of plastic is bonded to one side of the zipper, and wherein the first and second sheets of plastic are bonded together and attached to the other side of the zipper.

6. The bag of claim 1, wherein the plastic sheet is made of Low Density Polyethylene.

7. A bag having a closed bottom end with a tear-away zipper-closable pouch connected to the closed bottom end, comprising: a first sheet of plastic; a second sheet of plastic having an inner surface and an outer surface, the inner surface bonded to the first sheet of plastic to form the closed bottom end of the bag; a zipper attached to both the first and second sheets of plastic; and a tear-away perforation through the first and second sheets of plastic adjacent to the zipper, wherein the first and second sheets of plastic together form the bag and the pouch, and wherein the pouch is sealable by the zipper after the pouch has been removed from the closed bottom end of the bag, wherein the first sheet of plastic is bonded to one side of the zipper at one location, and is bonded to the other side of the zipper at another location.

8. The bag of claim 7, wherein the second sheet of plastic is bonded to the first sheet of plastic along a side of the zipper.

9. The bag of claim 7, wherein the plastic sheet is made of Low Density Polyethylene.

* * * * *